US005982093A

United States Patent [19]

Nihashi et al.

[11] Patent Number: 5,982,093

[45] Date of Patent: Nov. 9, 1999

[54] PHOTOCATHODE AND ELECTRON TUBE HAVING ENHANCED ABSORPTION EDGE CHARACTERISTICS

[75] Inventors: Tokuaki Nihashi; Toru Hirohata; Hideki Suzuki; Tuneo Ihara, all of Hamamatsu, Japan

[73] Assignee: Hamamatsu Photonics K.K., Hamamatsu, Japan

[21] Appl. No.: 08/835,715

[22] Filed: Apr. 10, 1997

[51] Int. Cl.[6] ..... H01J 40/06

[52] U.S. Cl. ..... 313/542; 313/544; 313/532; 313/534

[58] Field of Search ..... 313/542, 544, 313/532, 534

[56] References Cited

U.S. PATENT DOCUMENTS 3,387,161 6/1968 Van Laar et al. .
3,986,065 10/1976 Pankove .
4,616,248 10/1986 Khan et al. .
5,471,051 11/1995 Niigaki et al. ..... 313/542
5,557,167 9/1996 Kim et al. .

FOREIGN PATENT DOCUMENTS 8-96705 4/1996 Japan .

*Primary Examiner*—Vip Patel
*Attorney, Agent, or Firm*—Pillsbury Madison & Sutro, LLP

[57] ABSTRACT

The present invention relates to a photocathode having a structure for improving the quantum efficiency and sharpening the absorption edge characteristic on the long wavelength side within the wavelength range of incident light to improve the photosensitivity, and an electron tube having the same. The photocathode according to the present invention comprises at least a p-type GaAlN layer for absorbing incident light to excite photoelectrons, a p-type GaN layer which covers the second major surface of the p-type GaAlN layer, the second major surface opposing a first major surface that faces a substrate, and a surface layer provided to sandwich the p-type GaN layer with the p-type GaAlN layer and mainly containing an alkali metal or an alkali metal oxide.

13 Claims, 12 Drawing Sheets

———: PHOTOTUBE OF THE PRESENT INVENTION

------: CONVENTIONAL PHOTOTUBE

———— : PHOTOTUBE OF THE PRESENT INVENTION

- - - - - - - : CONVENTIONAL PHOTOTUBE

PHOTOCATHODE AND ELECTRON TUBE HAVING ENHANCED ABSORPTION EDGE CHARACTERISTICS

BACKGROUND OF THE INVENTION

1. Field of the Invention

The present invention relates to a photocathode applicable to an image-pickup tube or photometry device and a phototube having the same and, more particularly, a photocathode having a plurality of layers each mainly containing a compound semiconductor material and functioning so as to emit photoelectrons which are excited by incident light.

2. Related Background Art

Conventionally, a compound semiconductor layer of CsTe is applied to a photocathode for the UV range. The spectral sensitivity characteristic of this photocathode has a high radiation sensitivity to incident light having a wavelength of about 180 to 320 nm. However, to improve the quantum efficiency or absorption edge characteristic in the long wavelength side within the wavelength range of incident light, there is a decisive difficulty caused by a defect called a color center.

As a photocathode for the UV range for which various operation characteristics are expected to be improved as compared with the photocathode having the CsTe layer, a photocathode having a compound semiconductor layer mainly containing $Ga_{1-x}Al_xN$ ($0<x<1$) is available. The spectral sensitivity characteristic of this photocathode is adjusted by changing the absorption edge characteristic in the long wavelength side within the incident wavelength range of about 200 to 350 nm in correspondence with the composition of $Ga_{1-x}Al_xN$, i.e., an alloy of AlN and GaN.

Prior arts associated with such a photocathode having a layer mainly containing a compound semiconductor material of $Ga_{1-x}Al_xN$ are disclosed in, e.g., "U.S. Pat. No. 3,387,161 (1968)", "U.S. Pat. No. 3,986,065 (1976)", and Japanese Patent Laid-Open No. 61-267374.

SUMMARY OF THE INVENTION

The present inventors have found the following problems upon examining the above prior arts.

In the conventional photocathode, to improve the quantum efficiency, a Cs monomolecular layer is deposited on the $Ga_{1-x}Al_xN$ layer. With this structure, a negative electron affinity acts on photoelectrons excited in the conduction band of the $Ga_{1-x}Al_xN$ layer, so that the photoelectrons are easily emitted into the vacuum (outside the photocathode) through the Cs monomolecular layer.

However, the compound semiconductor material of $Ga_{1-x}Al_xN$ is easily oxidized because it contains Al. For this reason, when the phototube is to be manufactured, in the process of temporarily extracting the $Ga_{1-x}Al_xN$ layer from a vacuum system in which crystal growth is performed, transferring the $Ga_{1-x}Al_xN$ layer to another vacuum system, and sealing the $Ga_{1-x}Al_xN$ layer as a phototube, the surface of the $Ga_{1-x}Al_xN$ layer is easily oxidized upon contacting air.

To obtain a high quantum efficiency, a monomolecular layer of Cs oxide is formed on the $Ga_{1-x}Al_xN$ in place of the Cs monomolecular layer in some cases. With this structure, the negative electron affinity which acts on photoelectrons excited in the conduction band of the $Ga_{1-x}Al_xN$ layer further increases to the negative side. In the process of forming this monomolecular layer of the Cs oxide, the surface of the $Ga_{1-x}Al_xN$ layer is oxidized at a high probability upon contacting introduced oxygen.

When the monomolecular layer of Cs or Cs oxide is formed on this oxidized surface of the $Ga_{1-x}Al_xN$ layer, the work function of the surface of the $Ga_{1-x}Al_xN$ does not sufficiently decrease. No sufficient negative electron affinity can be obtained from the monomolecular layer of Cs or Cs oxide, resulting in a degradation in quantum efficiency or broadening of the absorption edge characteristic in the long wavelength side of incident light.

An object of the present invention is to provide a photocathode having a structure for preventing oxidation of the surface of a $Ga_{1-x}Al_xN$ layer to improve the quantum efficiency and also sharpens the absorption edge characteristic in the long wavelength side within the wavelength range of incident light to improve the photosensitivity, and an electron tube having the same.

A photocathode according to the present invention has a function of emitting photoelectrons excited by incident light. In a reflection type photocathode, a substrate for supporting the $Ga_{1-x}Al_xN$ layer is provided, and the photocathode is set at a predetermined position in the vacuum container of a phototube. In a transmission type photocathode, the $Ga_{1-x}Al_xN$ layer is provided on the inner wall of the vacuum container of a phototube, and part of the vacuum container is used as a substrate for supporting the $Ga_{1-x}Al_xN$ layer. With these arrangements, the photocathode is applied to the phototube.

More specifically, a photocathode according to the present invention comprises at least a light absorption layer for absorbing the incident light to excite the photoelectrons, the light absorption layer being a p-type compound semiconductor layer mainly containing $Ga_{1-x}Al_xN$ ($0<x<1$) and having a first major surface and a second major surface opposing the first major surface; a photoelectric emission layer being a p-type compound semiconductor layer mainly containing GaN, for drifting the excited photoelectrons, the photoelectric emission layer being covering and in direct contact with the first major surface of the light absorption layer; and a surface layer for emitting the excited photoelectrons outside the photocathode, the surface layer comprising at least one of an alkali metal and an alkali metal oxide and being provided at a position opposing the light absorption layer through the photoelectric emission layer.

Particularly, the photoelectric emission layer has a bandgap energy lower than that of the light absorption layer. The surface layer has a vacuum level lower than that of the conduction band of the photoelectric emission layer. With this structure, the energy level of the conduction band in the energy diagram of this photocathode is lowered from the light absorption layer toward the surface layer through the photoelectric emission layer.

The photocathode according to the present invention may have a substrate which is set at a predetermined position of the vacuum container of the phototube or constitutes part of the vacuum container. In both cases, the substrate is arranged at a position being opposite to the photoelectric emission layer through the light absorption layer. In addition, the substrate is preferably a plate member mainly containing sapphire.

The photocathode according to the present invention may have a contact layer provided between the substrate and the light absorption layer, the contact layer being a p-type compound semiconductor layer mainly containing GaN. The photocathode may have an electron shielding layer provided between the substrate and the light absorption layer, the electron shielding layer mainly containing a semiconductor material having a bandgap energy higher than that of the light absorption layer. The semiconductor material is preferably p-type AlN.

In the photocathode according to the present invention, the photoelectric emission layer mainly containing p-type GaN and the surface layer mainly containing an alkali metal or alkali metal oxide are sequentially laminated on the light absorption layer mainly containing p-type $Ga_{1-x}Al_xN$ ($0<x<1$). The major component of the light absorption layer, i.e., p-type $Ga_{1-x}Al_xN$ has a bandgap energy of about 3.5 to 6.0 eV. The major component of the photoelectric emission layer, i.e., p-type GaN has a bandgap energy lower than that of the light absorption layer. In addition, the major component of the surface layer, i.e., the alkali metal or alkali metal oxide has a vacuum level lower than that of the conduction band of the photoelectric emission layer. For this reason, the energy level of the conduction band in the energy diagram of this photocathode is lowered from the light absorption layer toward the surface layer through the photoelectric emission layer.

With this structure, when photons incident in the photocathode of the present invention have a predetermined energy, the photons are absorbed by the light absorption layer. At this time, electrons existing in the valence band of the light absorption layer are excited to the conduction band and become free electrons. For this reason, the photons are diffused or drifted along the conduction band which is lowered in level from the light absorption layer toward the photoelectric emission layer. The photons which are diffused or drifted from the light absorption layer to the photoelectric emission layer are emitted into the vacuum (outside the photocathode through the surface layer) by the negative electron affinity of the surface layer.

Since the photoelectric emission layer is a p-type compound semiconductor layer mainly containing p-type GaN, Al is not contained in the composition, unlike the light absorption layer. Therefore, the photoelectric emission layer is not easily oxidized, unlike the light absorption layer. The surface of the light absorption layer is covered with the photoelectric emission layer and therefore is not oxidized. In addition, the surface layer mainly containing the alkali metal or alkali metal oxide is provided on the photoelectric emission layer. Since the work function of the surface of the photoelectric emission layer is sufficiently decreased, a negative electron affinity by the surface layer can be sufficiently obtained. Therefore, in this photocathode, the quantum efficiency can be improved, and the absorption edge characteristic in the long wavelength side within the wavelength of incident light can be sharpened.

The major component of the photoelectric emission layer, i.e., p-type GaN can lattice-match the major component of the light absorption layer, i.e., p-type $Ga_{1-x}Al_xN$. For this reason, the photoelectric emission layer having a satisfactory crystallinity is epitaxially grown on the light absorption layer. Since almost no crystal defects are occurred in the photoelectric emission layer, the photocathode can obtain satisfactory photoelectron diffusion properties.

When an electron shielding layer is provided between the substrate and the light absorption layer, an energy barrier is formed between the light absorption layer and the electron shielding layer in the conduction band in the energy diagram of the photocathode because the electron shielding layer is a p-type layer and has a bandgap energy higher than that of the light absorption layer. For this reason, photoelectrons excited in the light absorption layer are diffused or drifted along the conduction band $E_C$ which is lowered in level from the light absorption layer toward the surface layer through the photoelectric emission layer without being diffused or drifted to the electron shielding layer side. Therefore, the quantum efficiency of the photocathode is further improved.

In particular, the major component of the electron shielding layer, i.e., AlN can lattice-match the major component of the light absorption layer, i.e., p-type $Ga_{1-x}Al_xN$. For this reason, the light absorption layer and photoelectric emission layer having a satisfactory crystallinity are epitaxially grown on the electron shielding layer. Since almost no crystal defects are occurred in the light absorption layer and the photoelectric emission layer, the photocathode can obtain satisfactory photoelectron diffusion properties.

In the phototube to which the photocathode (reflection type photocathode having a substrate) according to the present invention is applied, the photocathode and the anode are accommodated in the vacuum container to face each other. When a predetermined voltage is applied between the photocathode and the anode, an electric field is generated from the anode toward the photocathode. When photons having an energy higher than the bandgap energy of the light absorption layer are incident in the photocathode through the vacuum container, some photons are absorbed by the photoelectric emission layer, although most photons are transmitted through the photoelectric emission layer and absorbed by the light absorption layer. To reduce the number of photons absorbed by the photoelectric emission layer, the thickness of the photoelectric emission layer must be adjusted. According to the above-described function of the photocathode of the present invention, photoelectrons emitted into the vacuum through the surface layer travel while being accelerated by the electric field generated between the anode and the photocathode, are accepted by the anode, and detected.

In the phototube to which the photocathode (transmission type photocathode having a substrate constituting part of the vacuum container) according to the present invention is applied, the substrate of the photocathode is arranged as the window portion of the vacuum container, and the anode is accommodated in the vacuum container to face the photocathode. When a predetermined voltage is applied between the photocathode and the anode, an electric field is generated from the anode toward the photocathode. When photons having an energy higher than the bandgap of the light absorption layer are incident on the photocathode through the substrate (part of the vacuum container) of the photocathode, the photons are absorbed by the light absorption layer. According to the above-described function of the photocathode, photoelectrons emitted into the vacuum through the surface layer travel while being accelerated by the electric field generated between the anode and the photocathode, are accepted by the anode, and detected.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

Figure 1:
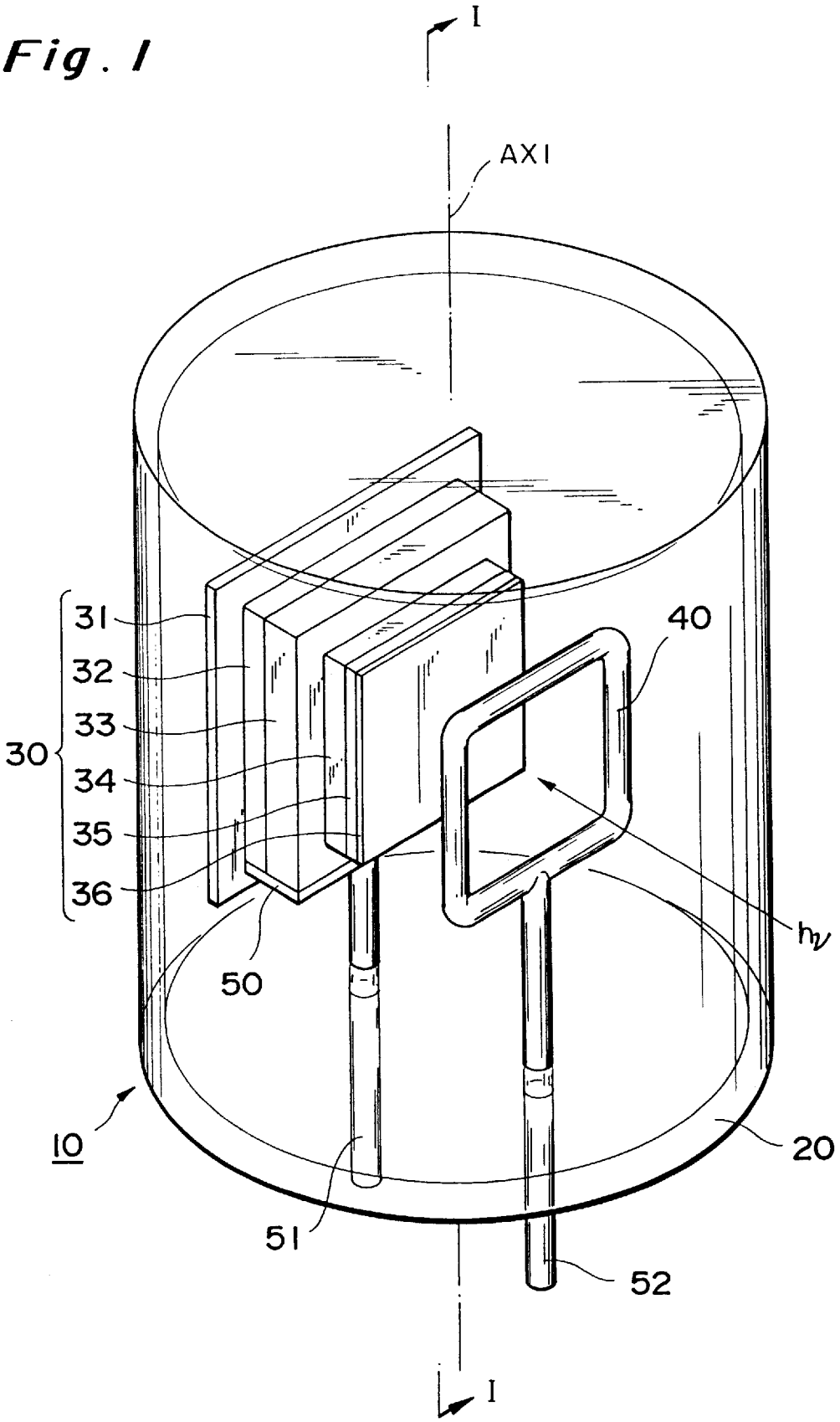
FIG. 1 is a perspective view showing the overall structure of a phototube to which a photocathode according to the first embodiment of the present invention is applied (reflection type photocathode)

The arrangements and functions of embodiments of a photocathode according to the present invention and a phototube having the photocathode will be described below in detail with reference to FIGS. 1 to 12. The same reference numerals denote the same elements throughout the drawings, and a detailed description thereof will be omitted. The dimensional ratio in the drawings does not necessarily match that in the description.

First Embodiment

Figure 2:
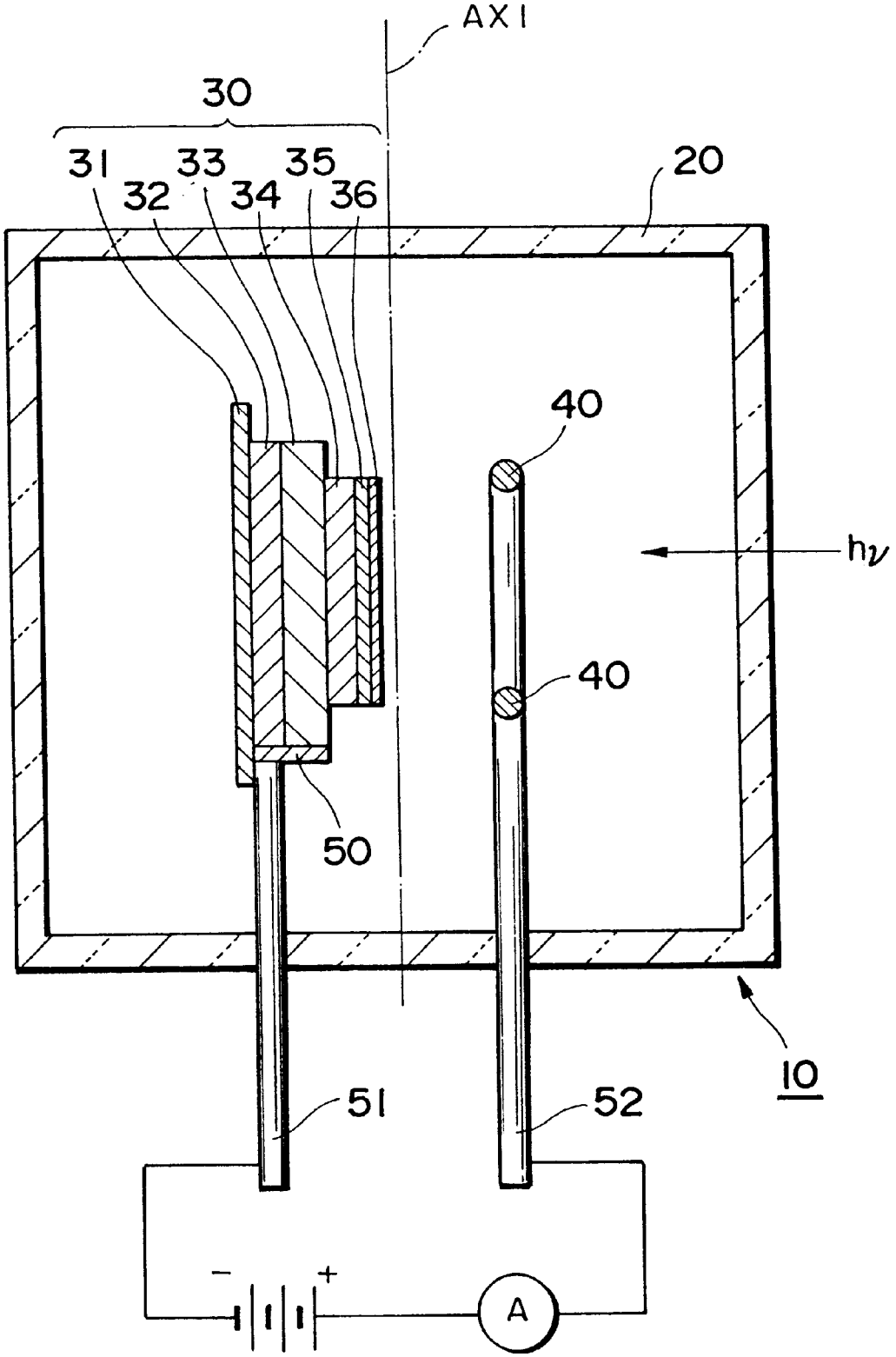
FIG. 2 is a sectional view showing the structure of the phototube taken along a line I—I in FIG. 1, to which the photocathode according to the first embodiment of the present invention is applied.

As shown in FIGS. 1 and 2, the phototube of the first embodiment has a so-called reflection type photocathode. Particularly, FIG. 2 is a sectional view of the phototube of the first embodiment, which is taken along a line I—I in FIG. 1.

As shown in FIGS. 1 and 2, in a phototube 10 of the first embodiment, a photocathode 30 and an anode 40 are accommodated in a vacuum container 20 to face each other by a predetermined distance. The vacuum container 20 is a hollow cylindrical glass container whose interior is held in a high vacuum state at a pressure of about $10^{-8}$ Torr. The photocathode 30 is supported by a metal lead pin 51 through a metal support table 50. The lead pin 51 extends from the bottom portion of the photocathode 30 through the bottom portion of the vacuum container 20 and is electrically connected to the cathode output terminal of an external power supply (see FIG. 2). A predetermined voltage is applied to the photocathode 30 through the lead pin 51 so that the potential of the photocathode 30 is set to be lower than that of the anode 40. The anode 40 is a metal electrode having a rectangular shape and is supported by a metal lead pin 52. The lead pin 52 extends from the bottom portion of the anode 40 through the bottom portion of the vacuum container 20 and is electrically connected to the anode output terminal of the external power supply (see FIG. 2). A predetermined voltage is applied to the anode 40 through the lead pin 52 so that the potential of the anode 40 is set to be higher than that of the photocathode 30.

In the photocathode 30, a substrate 32 is set on a predetermined surface area of a metal support plate 31. The support plate 31 mainly contains Mo and is shaped into a rectangular plate. The substrate 32 mainly contains of sapphire and is shaped into a rectangular plate. A contact layer 33, a light absorption layer 34, and a photoelectric emission layer 35 are sequentially laminated on the substrate 32 as various semiconductor layers.

The contact layer 33 is a p-type compound semiconductor layer mainly containing GaN and epitaxially grown so as to cover the entire surface area of the substrate 32. The contact layer 33 has a thickness of about 50 nm and is doped with a p-type dopant, i.e., Mg or Zn at a concentration of about $5\times10^{18}$ $cm^{-3}$.

The light absorption layer 34 is a p-type compound semiconductor layer mainly containing $Ga_{0.6}Al_{0.4}N$ and epitaxially grown so as to cover a predetermined surface area of the contact layer 33. The light absorption layer 34 has a thickness of about 200 nm and is doped with a p-type dopant, i.e., Mg or Zn at a concentration of about $1\times10^{17}$ to $1\times10^{18}$ $cm^{-3}$.

The photoelectric emission layer 35 is a p-type compound semiconductor layer mainly containing GaN and epitaxially grown so as to cover the entire surface area of the light absorption layer 34. The photoelectric emission layer 35 has a thickness of about 10 nm and is doped with a p-type dopant, i.e., Mg or Zn at a concentration of about $5\times10^{18}$ $cm^{-3}$. With this structure, the first major surface of the light absorption layer 34, which faces the sapphire substrate 32, contacts the contact layer 33 provided between the substrate 32 and the light absorption layer 34, and the second major surface of the light absorption layer 34, which faces the first major surface, contacts the photoelectric emission layer 35.

A surface layer 36 containing an alkali metal or an alkali metal oxide is deposited on the photoelectric emission layer 35. The surface layer 36 is a monomolecular layer containing Cs oxide and provided so as to cover the entire surface area of the photoelectric emission layer 35.

The photocathode 30 is arranged such that the surface of the support plate 31 is set parallel to a tube axis AX1 of the vacuum container 20 and along the side wall of the vacuum container 20. The plate-like support table 50 extending to be perpendicular to the tube axis AX1 is set at the bottom portion of the support plate 31 while contacting the side portions of the substrate 32 and contact layer 33 mainly containing Mo. The rod-like lead pin 51 extending along the tube axis AX1 and comprising a Kovar metal is attached to the central bottom portion of the support table 50.

The anode 40 is a metal ring having an opening at its center and arranged at a position facing the surface layer 36 of the photocathode 30. The rod-like lead pin 52 extending along the tube axis AX1 and comprising a Kovar metal is attached to the bottom portion of the anode 40.

Figure 3:
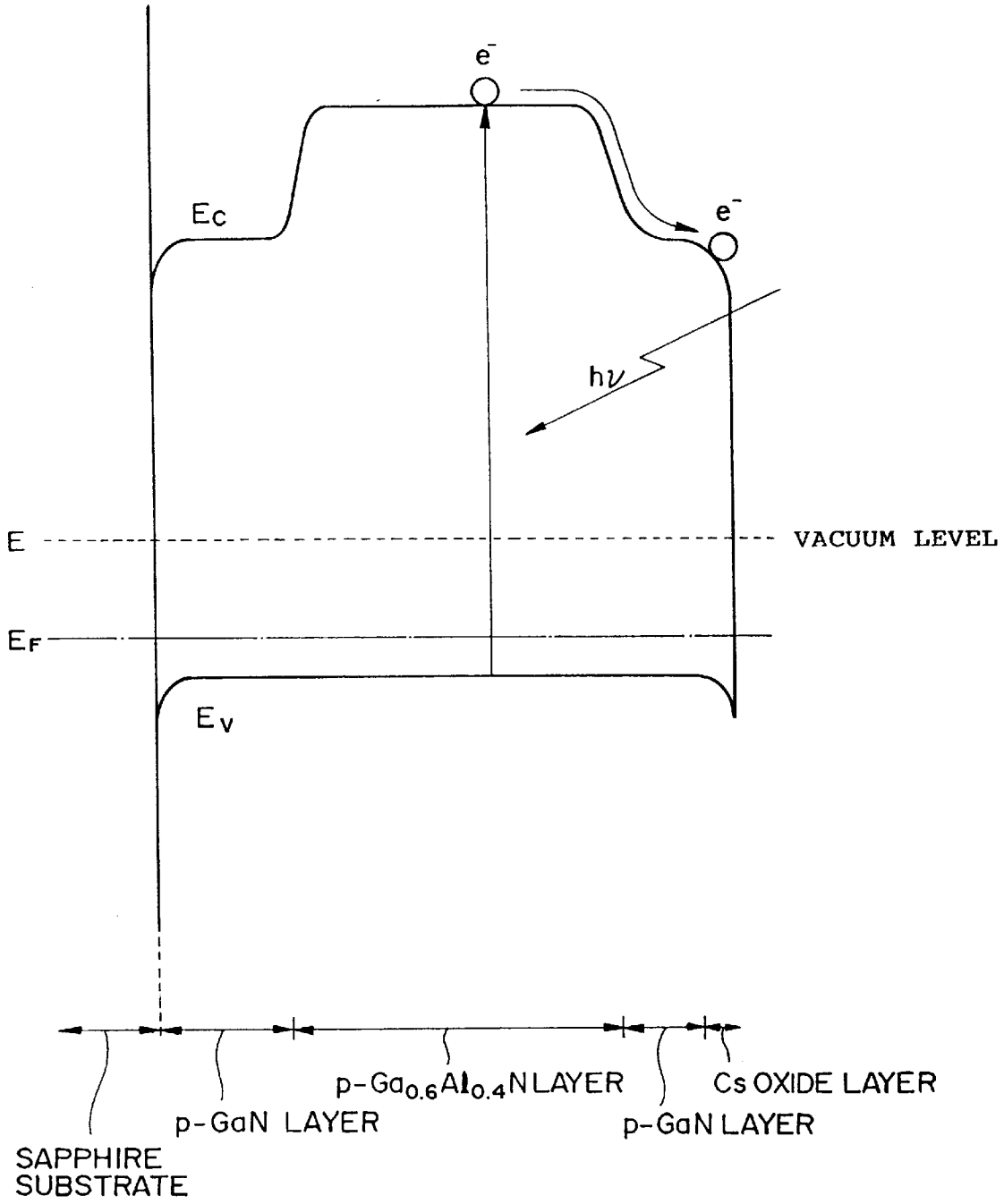
FIG. 3 is an energy diagram for explaining photoelectron emission process of the photocathode according to the first embodiment of the present invention.

As shown in FIG. 3 showing the energy diagram of the reflection type photocathode 30 of the present invention having the above structure, the energy level of a conduction band $E_C$ is lowered from the light absorption layer 34 toward the surface layer 36 through the photoelectric emission layer 35. The major component of the light absorption layer 34, i.e., p-type $Ga_{0.6}Al_{0.4}N$ has a bandgap energy of about 4.27 eV as the energy difference between the conduction band $E_C$ and a valence band $E_V$. The absorption edge on the long wavelength side within the wavelength range of incident light is at a wavelength of about 290 nm. On the other hand, the major component of the photoelectric emission layer 35, i.e., p-type GaN has a bandgap energy lower than that of the light absorption layer 34. The major component of the surface layer 36, i.e., the Cs oxide has a work function smaller than the energy difference between the conduction band $E_C$ and a Fermi level $E_F$ of the photoelectric emission layer 35 and has a vacuum level lower than that of the conduction band $E_C$ of the photoelectric emission layer 35.

The function of the first embodiment will be described below.

When a predetermined voltage is applied between the photocathode 30 and the anode 40 from the external power supply (see FIG. 2) through the lead pins 51 and 52, an electric field is generated from the anode 40 toward the photocathode 30. After this preparation, photons transmitted through the vacuum container 20 are incident on the photocathode 30 through the surface layer 36. When the photons have an energy higher than the bandgap energy of the light absorption layer 34, some photons are absorbed by the photoelectric emission layer 35, although most photons are transmitted through the photoelectric emission layer 35 and absorbed by the light absorption layer 34. To reduce the number of photons absorbed by the photoelectric emission layer 35, the thickness of the photoelectric emission layer 35 is adjusted to about 10 nm.

In the light absorption layer 34, electrons $e^-$ existing in the valence band $E_V$ are excited to the conduction band $E_C$ and become free electrons. The generated photoelectrons $e^-$ are diffused or drifted along the conduction band $E_C$ which is lowered in level from the light absorption layer 34 toward the surface layer 36 through the photoelectric emission layer 35 and are emitted into the vacuum (in the vacuum container 20 outside the photocathode 30) by the negative electron affinity of the surface layer 36. The emitted photoelectrons $e^-$ travel while being accelerated by the electric field generated between the anode 40 and the photocathode 30, are accepted by the anode 40, and detected by an external ammeter.

Since the photoelectric emission layer 35 is a p-type compound semiconductor layer mainly containing GaN, Al is not contained in the composition, unlike the light absorption layer 34. Therefore, the photoelectric emission layer 35 is not easily oxidized, unlike the light absorption layer 34. The surface of the light absorption layer 34 is covered with and in direct contact with the photoelectric emission layer 35, and therefore it is not easily oxidized. The surface layer 36 mainly containing the Cs oxide is provided on the photoelectric emission layer 35. Since the work function of the surface of the photoelectric emission layer 35 is sufficiently decreased by the surface layer 36, a negative electron affinity by the surface layer 36 can be obtained. Therefore, in the reflection type photocathode 30, the quantum efficiency is improved, and the absorption edge characteristic on the long wavelength side within the wavelength range of incident light is sharpened.

The major component of the photoelectric emission layer 35, i.e., p-type GaN can lattice-match the major component of the light absorption layer 34, i.e., p-type $Ga_{0.6}Al_{0.4}N$. For this reason, the photoelectric emission layer 35 having a satisfactory crystallinity is epitaxially grown on the light absorption layer 34. Since almost no crystal defects are occurred in the photoelectric emission layer 35, the photocathode 30 can obtain satisfactory photoelectron diffusion properties.

The photoelectric emission layer 35 has a bandgap energy lower than that of the light absorption layer 34 so the conduction band $E_C$ of the photoelectric emission layer 35 is lower than that of the light absorption layer 34. Since photoelectrons excited in the light absorption layer 34 are efficiently diffused or drifted along the electric field directing the surface layer 36, photoelectron emission can be achieved at a high quantum efficiency.

A method of manufacturing the photocathode according to the first embodiment will be described below.

In this manufacturing method, conventional MOCVD (Metal Organic Chemical Vapor Deposition) is used. First, the substrate 32 is set in a reaction vessel. After the reaction vessel is evacuated, hydrogen gas is introduced as a carrier gas. Next, while holding the interior of the reaction vessel at a predetermined pressure, the substrate 32 is heated to a predetermined temperature, and reaction gases are introduced into the reaction vessel. In this process, by controlling the flow rate of each source gas to be mixed as a reaction gas to a predetermined rate, various semiconductor layers are epitaxially grown on the substrate 32.

First, as source gases, $Ga(CH_3)_3$, $NH_3$, and $Mg(C_5H_5)_2$ or $Zn(CH_3)_2$ are introduced into the reaction vessel to form the contact layer 33 on the substrate 32. The flow rates of the source gases are as follows: about 10 to 20 $cm^3$/min for $Ga(CH_3)_3$, about 11 to 21 $cm^3$/min for $NH_3$, and about 0.8 to 2.6 $cm^3$/min for $Mg(C_5H_5)_2$ or $Zn(CH_3)_2$. The surface temperature of the substrate 32 is about 940 to 1,100° C. The internal pressure of the reaction vessel is about 760 Torr. The growth time is about 1.5 to 2 min.

Next, as source gases, $Ga(CH_3)_3$, $Al(CH_3)_3$, $NH_3$, and $Mg(C_5H_5)_2$ or $Zn(CH_3)_2$ are introduced into the reaction vessel to form the light absorption layer 34 on the contact layer 33. The flow rates of the source gases are as follows: about 10 to 20 $cm^3$/min for $Ga(CH_3)_3$, about 11 to 21 $cm^3$/min for $NH_3$, about 10 to 20 $cm^3$/min for $Al(CH_3)_3$, and about 0.4 $cm^3$/min to 1.5 $cm^3$/min for $Mg(C_5H_5)$ or $Zn(CH_3)_2$. The surface temperature of the substrate 32 is about 940 to 1,100° C. The internal pressure of the reaction vessel is about 760 Torr. The growth time is about 6 to 8 min.

Subsequently, as source gases, $Ga(CH_3)_3$, $NH_3$, and $Mg(C_5H_5)_2$ or $Zn(CH_3)_2$ are introduced into the reaction vessel to form the photoelectric emission layer 35 on the light absorption layer 34. The flow rates of the source gases are as follows: about 10 to 20 $cm^3$/min for $Ga(CH_3)_3$, about 11 to 21 $cm^3$/min for $NH_3$, and about 0.8 to 2.6 $cm^3$/min for $Mg(C_5H_5)_2$ or $Zn(CH_3)_2$. The surface temperature of the substrate 32 is about 940 to 1,100° C. The internal pressure of the reaction vessel is about 760 Torr. The growth time is about 20 to 25 sec.

The substrate 32 on which the various semiconductor layers are laminated is temporarily removed from the reaction vessel and subjected to patterning by conventional photolithography. In this patterning, an etching mask layer having a predetermined pattern is patterned on the photoelectric emission layer 35. The photoelectric emission layer 35 and the light absorption layer 34 are formed into a rectangular pattern by conventional wet etching. Thereafter, the etching mask layer on the photoelectric emission layer 35 is removed.

The support plate 31 is bonded to the lower surface of the substrate 32 which has undergone the above process. At the same time, the support table 50 is bonded to the side portions of the substrate 32 and the contact layer 33. Thereafter, the substrate 32 is set in the vacuum container 20. The Cs oxide is deposited, by conventional vacuum deposition, on the surface of the photoelectric emission layer 35 which is provided on the substrate 32 set at a predetermined position in the vacuum container 20, to form the surface layer 36. The vacuum container 20 is sealed in a high vacuum state, thereby obtaining the phototube 10 having the reflection type photocathode 30.

A comparison experiment for the phototube (the first embodiment shown in FIGS. 1 and 2) having the reflection type photocathode of the present invention and the conventional phototube will be described below.

For the phototube of the first embodiment, the light absorption layer and photoelectric emission layer of the photocathode were formed of p-type compound semiconductor layers mainly containing $Ga_{0.6}Al_{0.4}N$ and GaN, respectively, as described above. The conventional phototube has almost the same structure as that of the first embodiment except the photocathode. More specifically, the light absorption layer of the photocathode is formed of a compound semiconductor layer mainly containing CsTe. Short-wavelength light is irradiated on these phototubes, and the quantum efficiencies are measured.

Figure 4:
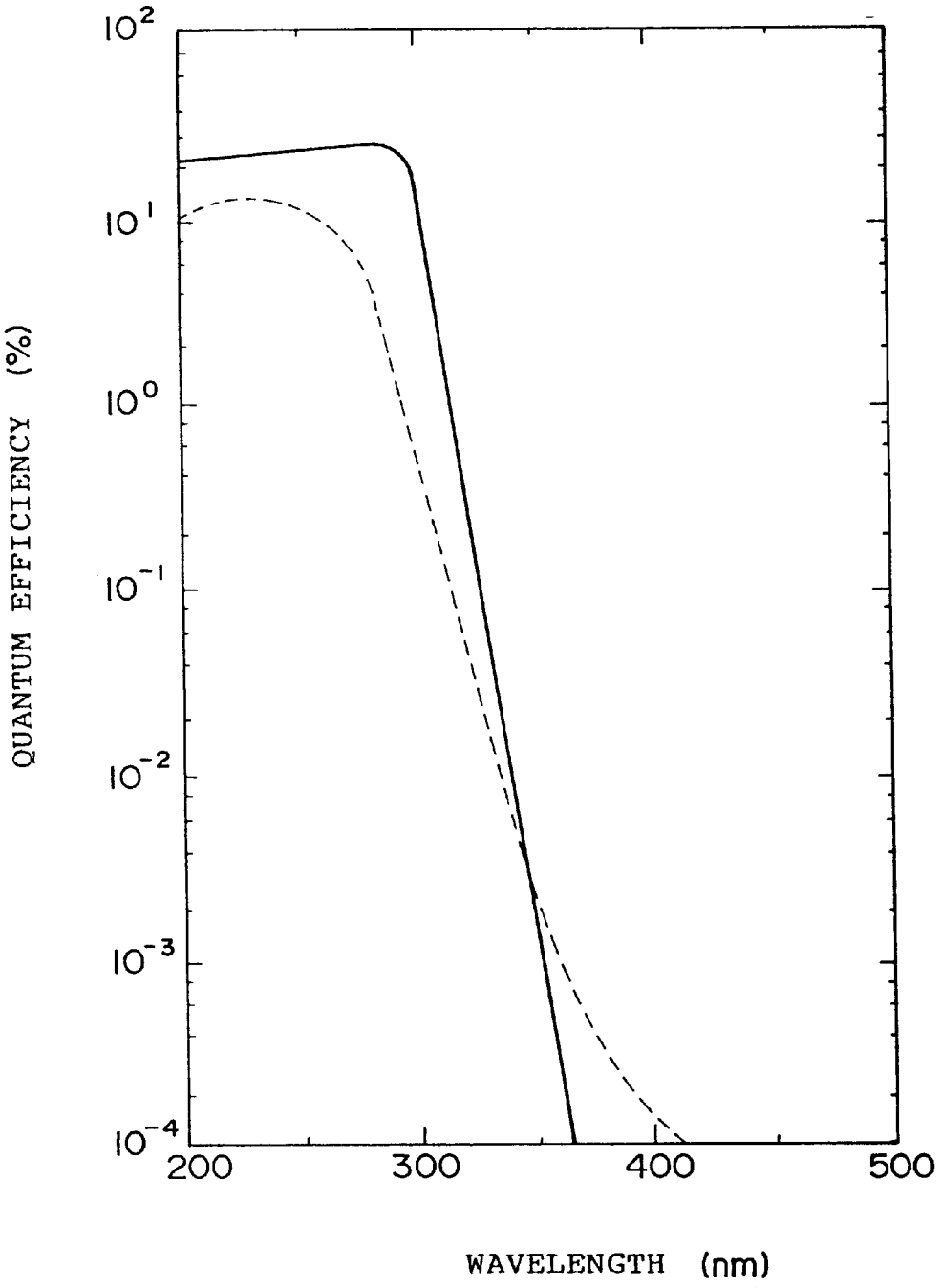
FIG. 4 is a graph showing the spectral sensitivity characteristic of the phototube shown in FIG. 1.

FIG. 4 is a graph showing the spectral sensitivity characteristics of the phototube of the first embodiment and the conventional phototube. According to this graph, for light having a wavelength of about 200 to 350 nm, the quantum efficiency of the phototube of the first embodiment is higher than that of the conventional phototube. In addition, the absorption edge of the phototube of the first embodiment on the long wavelength side within the wavelength range of incident light is sharper than that of the conventional phototube.

Second Embodiment

Figure 5:
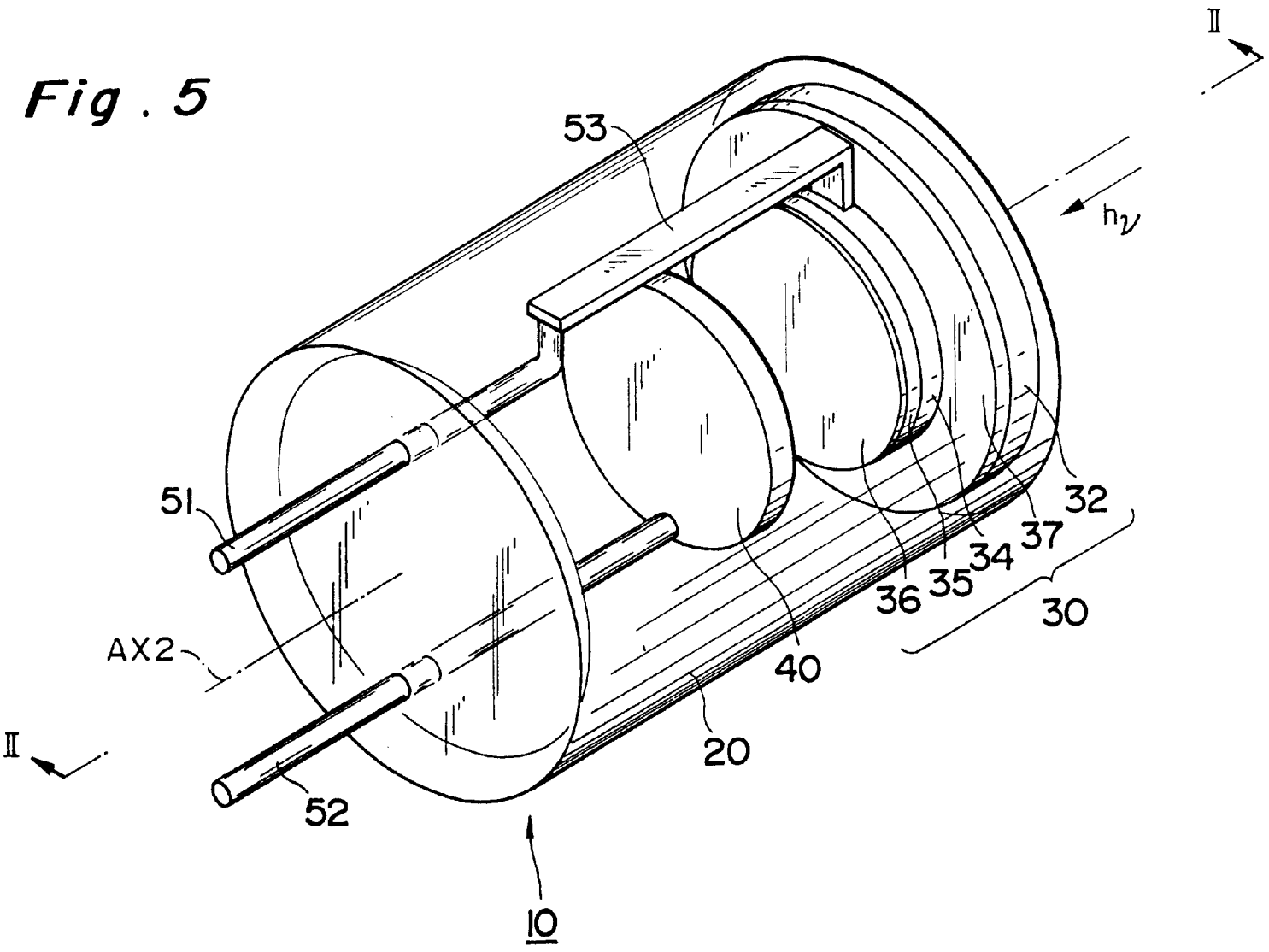
FIG. 5 is a perspective view showing the overall structure of a phototube to which a photocathode according to the second embodiment of the present invention is applied (transmission type photocathode)
Figure 6:
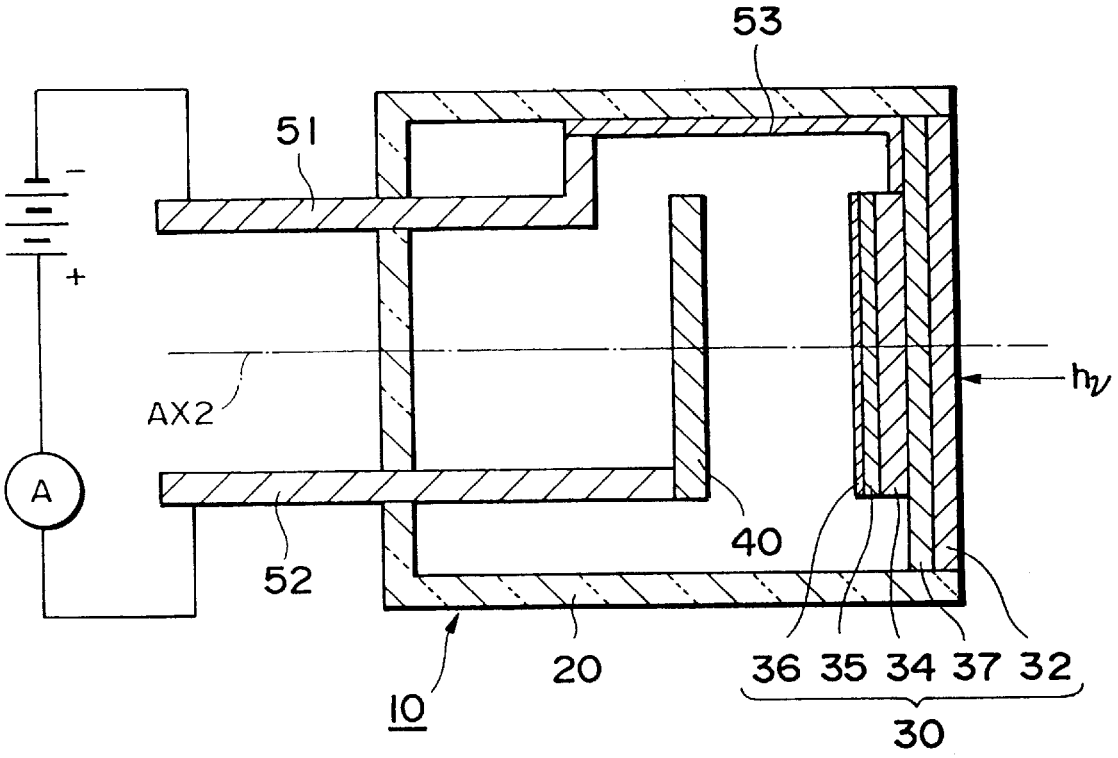
FIG. 6 is a sectional view showing the structure of the phototube taken along a line II—II in FIG. 5, to which the photocathode according to the second embodiment of the present invention is applied.

The phototube of the second embodiment has a so-called transmission type photocathode, as shown in FIGS. 5 and 6. Particularly, FIG. 6 is a sectional view of the phototube of the second embodiment (FIG. 5), which is taken along a line II—II in FIG. 5.

As shown in FIGS. 5 and 6, in a phototube 10 of the second embodiment, a photocathode 30 and an anode 40 serving as the window portions of a vacuum container 20 are accommodated in the vacuum container 20 to face each other by a predetermined distance. The vacuum container 20 is constituted by a hollow cylindrical glass container whose one end is open and a substrate 32 of the photocathode 30. The vacuum container 20 is hermetically sealed by the glass container and the substrate 32 while holding its interior in a high vacuum state at a pressure of about $10^{-8}$ Torr. With this structure, part of the vacuum container 20 functions as the substrate 32 of the photocathode 30.

The photocathode 30 is supported by the side wall portion of the vacuum container 20 to hermetically seal the vacuum container 20. The photocathode 30 is connected to a metal lead pin 51 through a metal wiring layer 53. The lead pin 51 extends from the end portion of the wiring layer 53 through the bottom portion of the vacuum container 20 and is electrically connected to the cathode output terminal of an external power supply (see FIG. 6). A predetermined voltage is applied to the photocathode 30 through the lead pin 51 so that the potential of the photocathode 30 is set to be lower than that of the anode 40.

The anode 40 is a metal electrode having a circular plate-like shape and is supported by a metal lead pin 52. The lead pin 52 extends from the end portion of the anode 40 through the bottom portion of the vacuum container 20 and is electrically connected to the anode output terminal of the external power supply (see FIG. 6). A predetermined voltage is applied to the anode 40 through the lead pin 52 so that the potential of the anode 40 is set to be higher than that of the photocathode 30.

In the photocathode 30, the substrate 32 is joined to the side wall portion of the vacuum container 20 and functions as the window portion of the vacuum container 20. An electron shielding layer 37, a light absorption layer 34, and a photoelectric emission layer 35 are sequentially laminated on the substrate 32 as various semiconductor layers.

The electron shielding layer 37 is a p-type compound semiconductor layer mainly containing AlN and epitaxially grown so as to cover the entire surface area of the substrate 32. The electron shielding layer 37 has a thickness of about 75 nm and is doped with a p-type dopant, i.e., Mg or Zn at a concentration of about $1\times10^{18}$ to $5\times10^{18}$ $cm^{-3}$.

The light absorption layer 34 is a p-type compound semiconductor layer mainly containing $Ga_{0.6}Al_{0.4}N$ and epitaxially grown so as to cover a predetermined surface area of the electron shielding layer 37. The light absorption layer 34 has a thickness of about 200 nm and is doped with a p-type dopant, i.e., Mg or Zn at a concentration of about $1\times10^{17}$ to $1\times10^{18}$ $cm^{-3}$.

The photoelectric emission layer 35 is a p-type compound semiconductor layer mainly containing GaN and epitaxially grown so as to cover the entire surface area of the light absorption layer 34. The photoelectric emission layer 35 has a thickness of about 10 nm and is doped with a p-type dopant, i.e., Mg or Zn at a concentration of about $5\times10^{18}$ $cm^{-3}$. With this structure, the first major surface of the light absorption layer 34, which faces the sapphire substrate 32, contacts the electron shielding layer 37 provided between the substrate 32 and the light absorption layer 34, and the second major surface of the light absorption layer 34, which faces the first major surface, contacts the photoelectric emission layer 35.

A surface layer 36 comprising an alkali metal oxide is deposited on the photoelectric emission layer 35. The surface layer 36 is a monomolecular layer including Cs oxide and provided so as to cover the entire surface area of the photoelectric emission layer 35.

The photocathode 30 is set to be joined to the side wall portion of the vacuum container 20 such that the surface of the substrate 32 is arranged to be perpendicular to an tube axis AX2 of the vacuum container 20. The Al wiring layer 53 coating the side wall of the vacuum container 20 along the tube axis AX2 is arranged aside the photocathode 30. The Al wiring layer 53 electrically contacts the surface of the electron shielding layer 37 and the side portion of the light absorption layer 34. The rod-like lead pin 51 extending along the tube axis AX2 and comprising a Kovar metal is attached to the end portion of the Al wiring layer 53.

The anode 40 is arranged at a position facing the surface layer 36 of the photocathode 30. The rod-like lead pin 52 extending along the tube axis AX2 and comprising a Kovar metal is attached to the end portion of the anode 40.

Figure 7:
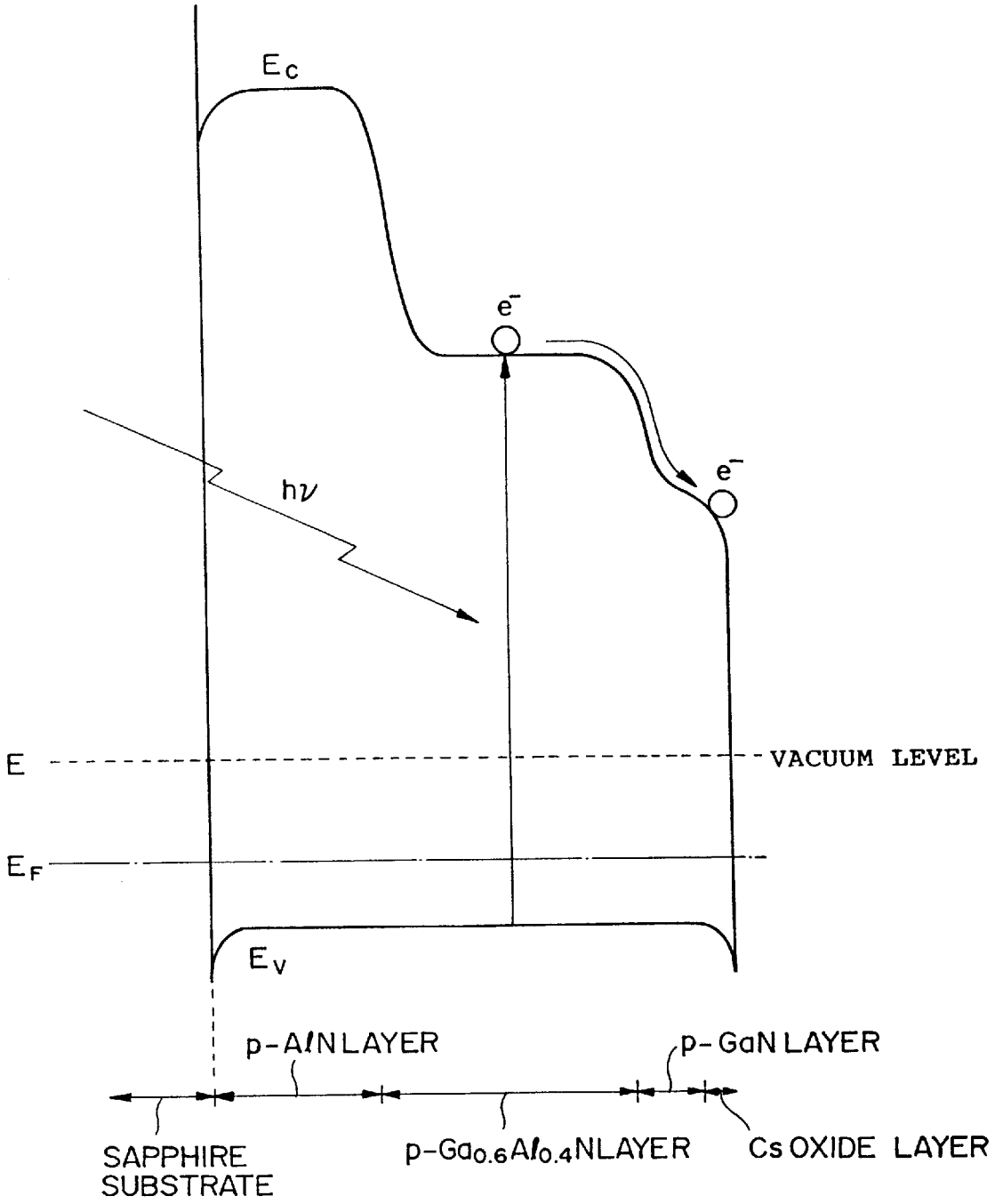
FIG. 7 is an energy diagram for explaining photoelectron emission process of the photocathode according to the second embodiment of the present invention.

As shown in FIG. 7 showing the energy diagram of the photocathode 30 of the present invention having the above structure, the energy level of a conduction band $E_C$ is lowered from the electron shielding layer 37 toward the surface layer 36 through the light absorption layer 34 and the photoelectric emission layer 35. The major component of the light absorption layer 34, i.e., p-type $Ga_{0.6}Al_{0.4}N$ has a bandgap energy of about 4.27 eV as the energy difference between the conduction band $E_C$ and a valence band $E_V$. The absorption edge on the long wavelength side within the wavelength range of incident light is at a wavelength of about 290 nm.

On the other hand, the major component of the photoelectric emission layer 35, i.e., p-type GaN has a bandgap energy lower than that of the light absorption layer 34. The major component of the electron shielding layer 37, i.e., p-type AlN has a bandgap energy higher than that of the light absorption layer 34. The major component of the surface layer 36, i.e., the Cs oxide has a work function smaller than the energy difference between the conduction band $E_C$ and a Fermi level $E_F$ of the photoelectric emission layer 35 and has a vacuum level lower than that of the conduction band $E_C$ of the photoelectric emission layer 35.

The function of the second embodiment will be described below.

When a predetermined voltage is applied between the photocathode 30 and the anode 40 from the external power supply (FIG. 6) through the lead pins 51 and 52, an electric field is generated from the anode 40 toward the photocathode 30. After this preparation, photons transmitted through the substrate 32 (part of the vacuum container 20) of the photocathode 30 are incident in the photocathode 30. When the photons have an energy lower than that of the electron shielding layer 37 and higher than the bandgap energy of the light absorption layer 34, photons are transmitted through the electron shielding layer 37 and absorbed by the light absorption layer 34.

In the light absorption layer 34, electrons $e^-$ existing in the valence band $E_V$ are excited to the conduction band $E_C$ and become free electrons. Since an energy barrier is present between the light absorption layer 34 and the electron shielding layer 37, the generated photoelectrons $e^-$ are diffused or drifted along the conduction band $E_C$ which is lowered in level from the light absorption layer 34 toward the surface layer 36 through the photoelectric emission layer 35 without being diffused or drifted into the electron shielding layer 37, and emitted into the vacuum (in the vacuum container 20 outside the photocathode) by the negative electron affinity of the surface layer 36. The emitted photoelectrons $e^-$ travel while being accelerated by the electric field generated between the anode 40 and the photocathode 30, are accepted by the anode 40, and detected by an external ammeter.

Since the photoelectric emission layer 35 is a p-type compound semiconductor layer mainly containing GaN, Al is not contained in the composition, unlike the light absorption layer 34. Therefore, the photoelectric emission layer 35 is not easily oxidized, unlike the light absorption layer 34. The surface of the light absorption layer 34 is covered with and in direct contact with the photoelectric emission layer 35, and therefore it is not easily oxidized. In addition, the surface layer 36 mainly containing the Cs oxide is provided on the photoelectric emission layer 35. Since the work function of the surface of the photoelectric emission layer 35 is sufficiently decreased by the surface layer 36, a negative electron affinity by the surface layer 36 can be obtained. Therefore, in the photocathode 30, the quantum efficiency is improved, and the absorption edge characteristic on the long wavelength side within the wavelength range of incident light is sharpened.

The major component of the electron shielding layer 37, i.e., p-type AlN and the major component of the photoelectric emission layer 35, i.e., p-type GaN can lattice-match the major component of the light absorption layer 34, i.e., p-type $Ga_{0.6}Al_{0.4}N$. For this reason, the light absorption layer 34 and photoelectric emission layer 35 having a satisfactory crystallinity are epitaxially grown on the electron shielding layer 37. Since almost no crystal defects are occurred in the light absorption layer 34 and the photoelectric emission layer 35, the photocathode 30 can obtain satisfactory photoelectron diffusion properties.

The electron shielding layer 37 has a bandgap energy higher than that of the light absorption layer 34 so the conduction band $E_C$ of the electron shielding layer 37 is higher in level than that of the light absorption layer 34. Since photoelectrons excited in the light absorption layer 34 are diffused or drifted along the electric field directing the surface layer 36, the photoelectrons are not diffused or drifted into the electron shielding layer 37. On the other hand, the photoelectric emission layer 35 has a bandgap energy lower than that of the light absorption layer 34 so the conduction band $E_C$ of the photoelectric emission layer 35 is lower in level than that of the light absorption layer 34. Since photoelectrons excited in the light absorption layer 34 are efficiently diffused or drifted along the electric field generated from the light absorption layer toward the surface layer 36. The photoelectrons excited in the light absorption layer 34 are diffused or drifted into the photoelectric emission layer 35 without being diffused or drifted into the electron shielding layer 37. Therefore, the photocathode 30 can obtain a higher quantum efficiency (efficient photoelectron emission).

A method of manufacturing the photocathode according to the second embodiment will be described below.

In this manufacturing method as well, conventional MOCVD is used. First, the substrate 32 is set in a reaction vessel. After the reaction vessel is evacuated, hydrogen gas is introduced as a carrier gas. Next, while holding the interior of the reaction vessel at a predetermined pressure, the substrate 32 is heated to a predetermined temperature, and reaction gases are introduced into the reaction vessel. In this process, by controlling the flow rate of each source gas to be mixed as a reaction gas to a predetermined rate, various semiconductor layers are epitaxially grown on the substrate 32.

First, as source gases, $Al(CH_3)_3$, $NH_3$, and $Mg(C_5H_5)_2$ or $Zn(CH_3)_2$ are introduced into the reaction vessel to form the electron shielding layer 37 on the substrate 32. The flow rates of the source gases are as follows: about 10 to 20 $cm^3$/min for $Al(CH_3)_3$, about 11 to 21 $cm^3$/min for $NH_3$, and about 0.8 to 2.6 $cm^3$/min for $Mg(C_5H_5)_2$ or $Zn(CH_3)_2$. The surface temperature of the substrate 32 is about 940 to 1,100° C. The internal pressure of the reaction vessel is about 760 Torr. The growth time is about 6 to 8 min.

Next, as source gases, $Ga(CH_3)_3$, $Al(CH_3)_3$, $NH_3$, and $Mg(C_5H_5)_2$ or $Zn(CH_3)_2$ are introduced into the reaction vessel to form the light absorption layer 34 on the electron shielding layer 37. The flow rates of the source gases are as follows: about 10 to 20 $cm^3$/min for $Ga(CH_3)_3$, about 11 to 21 $cm^3$/min for $NH_3$, about 10 to 20 $cm^3$/min for $Al(CH_3)_3$, and about 0.4 $cm^3$/min to 1.5 $cm^3$/min for $Mg(C_5H_5)$ or $Zn(CH_3)_2$. The surface temperature of the substrate 32 is about 940 to 1,100° C. The internal pressure of the reaction vessel is about 760 Torr. The growth time is about 6 to 8 min.

Subsequently, as source gases, $Ga(CH_3)_3$, $NH_3$, and $Mg(C_5H_5)_2$ or $Zn(CH_3)_2$ are introduced into the reaction vessel to form the photoelectric emission layer 35 on the light absorption layer 34. The flow rates of the source gases are as follows: about 10 to 20 $cm^3$/min for $Ga(CH_3)_3$, about 11 to 21 $cm^3$/min for $NH_3$, and about 0.8 to 2.6 $cm^3$/min for $Mg(C_5H_5)_2$ or $Zn(CH_3)_2$. The surface temperature of the substrate 32 is about 940 to 1,100° C. The internal pressure of the reaction vessel is about 760 Torr. The growth time is about 20 to 25 sec.

The substrate 32 on which the various semiconductor layers are laminated is temporarily removed from the reaction vessel and subjected to patterning by conventional photolithography. In this patterning, an etching mask layer having a predetermined pattern is formed on the photoelectric emission layer 35. The photoelectric emission layer 35 and the light absorption layer 34 are shaped into a circular pattern by conventional wet etching. Thereafter, the etching mask layer on the photoelectric emission layer 35 is removed.

The side portion of the substrate 32 which has undergone the above process is fused to the side wall portion of the vacuum container 20 to constitute part of the vacuum container 20. In addition, the wiring layer 53 is electrically connected to the surface of the electron shielding layer 37 and the side portion of the light absorption layer 34. Thereafter, the Cs oxide is deposited, by conventional vacuum deposition, on the surface of the photoelectric emission layer 35 to form the surface layer 36. The vacuum container 20 is sealed in a high vacuum state, thereby obtaining the phototube 10 having the transmission type photocathode 30.

A comparison experiment for the phototube (the second embodiment shown in FIGS. 5 and 6) having the transmission type photocathode of the present invention and the conventional phototube will be described below.

For the phototube of the second embodiment, the electron shielding layer, the light absorption layer, and the photoelectric emission layer of the photocathode were laminated of p-type compound semiconductor layers mainly containing AlN, $Ga_{0.6}Al_{0.4}N$ and GaN, respectively, as described above. The conventional phototube had almost the same structure as that of the second embodiment except the photocathode. More specifically, the light absorption layer of the photocathode was formed of a compound semiconductor layer mainly containing CsTe. Short-wavelength light was irradiated on these phototubes, and the quantum efficiencies were measured.

Figure 8:
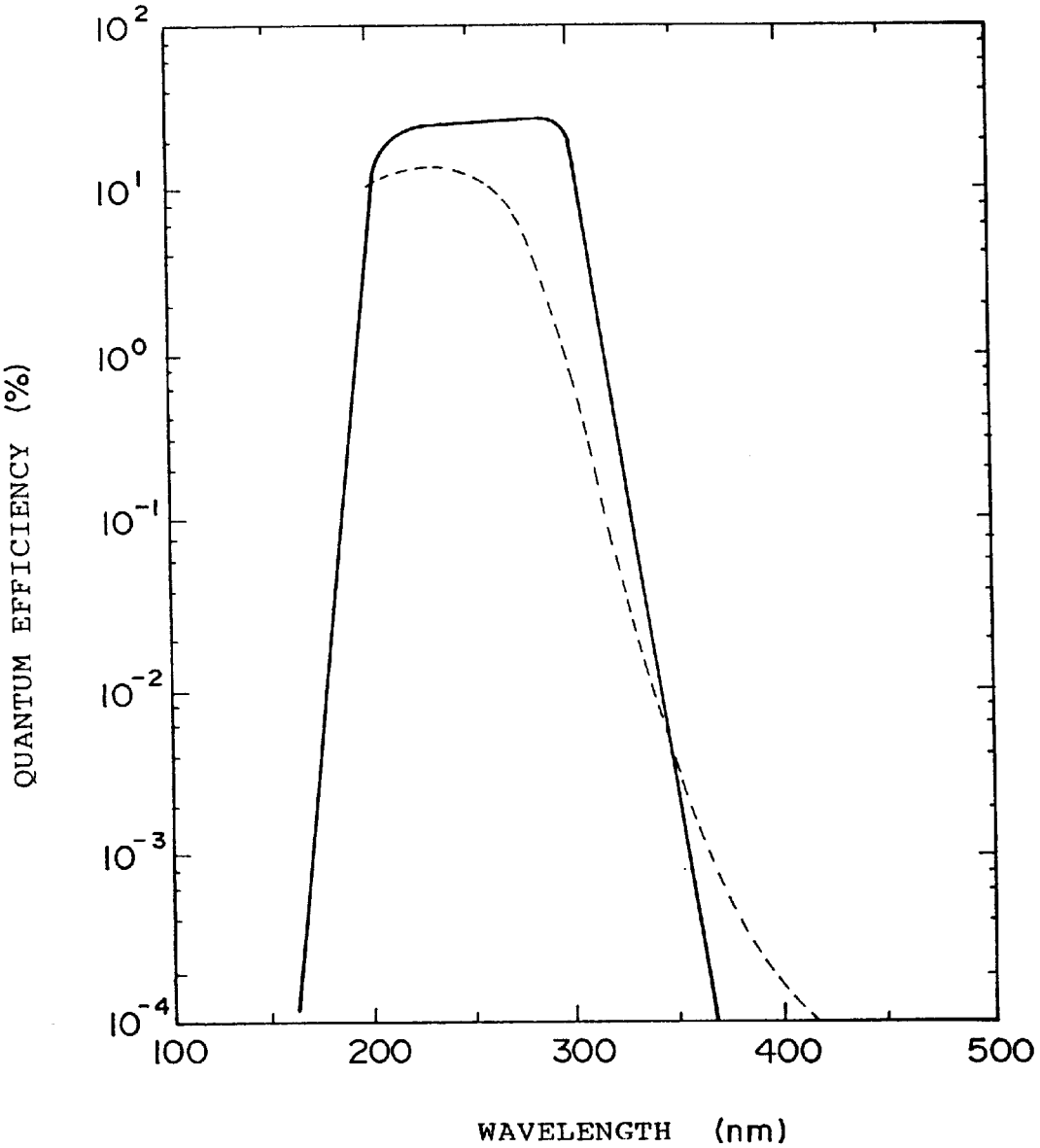
FIG. 8 is a graph showing the spectral sensitivity characteristic of the phototube shown in FIG. 5.

FIG. 8 is a graph showing the spectral sensitivity characteristics of the phototube of the second embodiment and the conventional phototube. According to this graph, for light having a wavelength of about 200 to 350 nm, the quantum efficiency of the phototube of the second embodiment is higher than that of the conventional phototube. The sapphire substrate used for the phototube of the second embodiment has a minimum transmittance with respect to light having a wavelength of about 200 nm. Since the phototube has a transmission type photocathode having the above structure, the spectral sensitivity characteristic on the short wavelength side within the wavelength range of incident light is largely limited by the optical characteristics of the substrate. As is apparent from FIG. 8, the absorption edge characteristic of the phototube on the long wavelength side within the wavelength range of incident light is improved as compared with the conventional phototube.

Third Embodiment

In the third embodiment (FIGS. 9 and 10), the phototube has a so-called reflection type photocathode having almost the same structure as that of the first embodiment (FIGS. 1 and 2). Particularly, FIG. 10 is a sectional view of the phototube of the third embodiment (FIG. 9), which is taken along a line III—III in FIG. 9.

Figure 9:
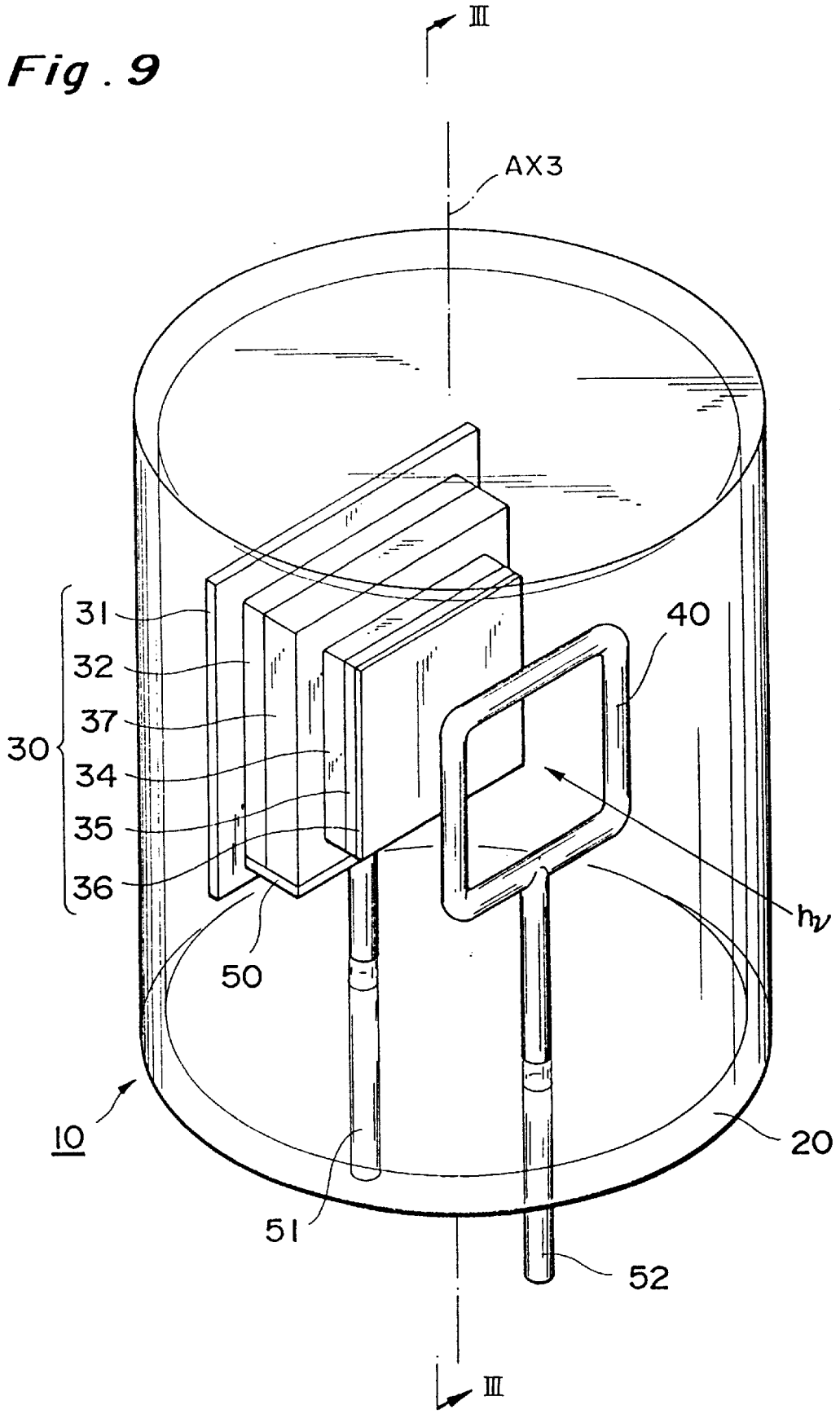
FIG. 9 is a perspective view showing the overall structure of a phototube to which a photocathode according to the third embodiment of the present invention is applied (reflection type photocathode)
Figure 10:
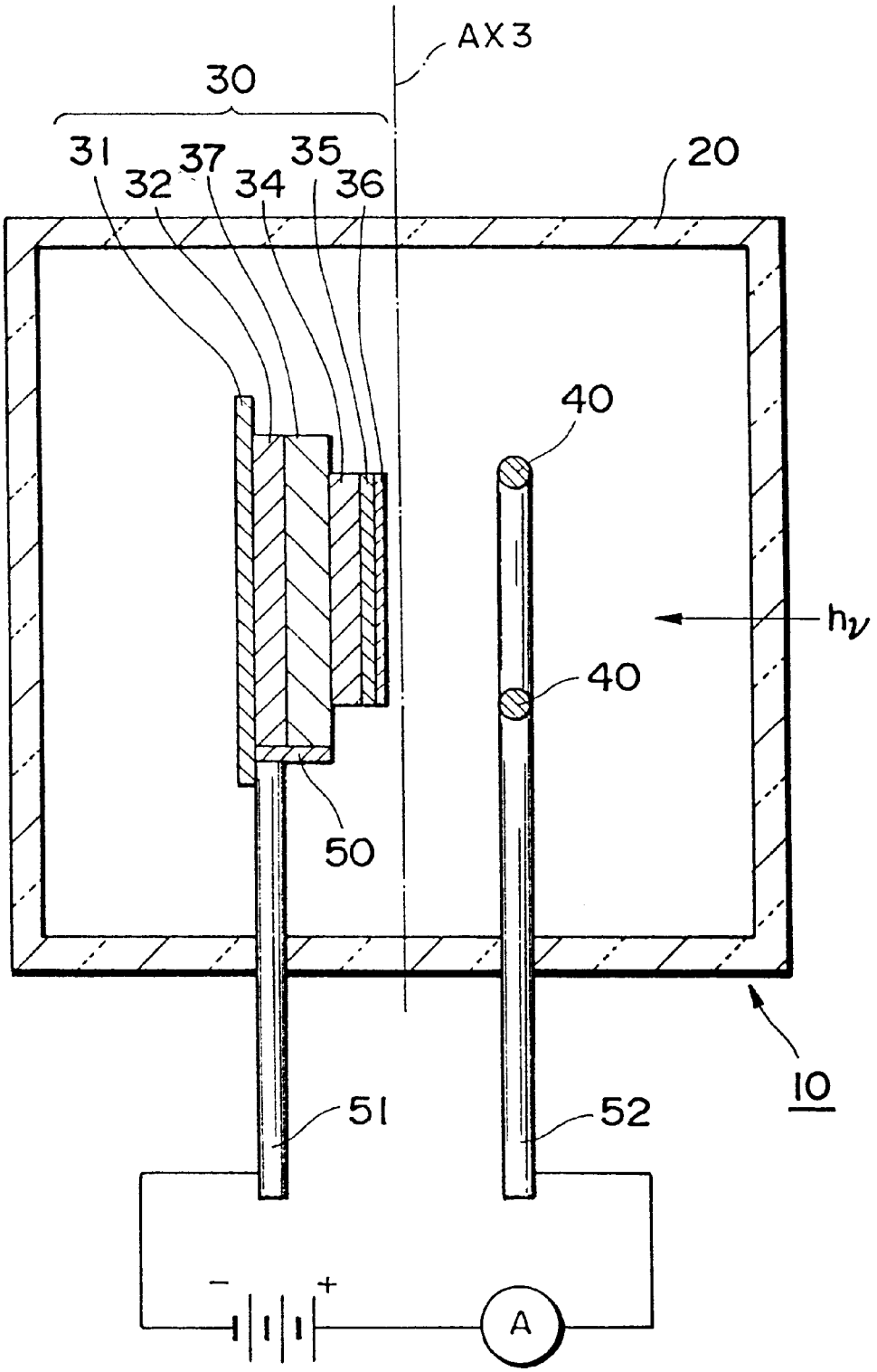
FIG. 10 is a sectional view showing the structure of the phototube taken along a line III—III in FIG. 9, to which the photocathode according to the third embodiment of the present invention is applied.

As shown in FIGS. 9 and 10, a phototube 10 of the third embodiment is different from the phototube 10 of the first embodiment in that an electron shielding layer 37 as in the photocathode 30 shown in FIGS. 5 and 6 is provided between a substrate 32 and a light absorption layer 34 of a photocathode 30. More specifically, the electron shielding layer 37 is a p-type compound semiconductor layer mainly containing AlN and epitaxially grown so as to cover the entire surface area of the substrate 32. The electron shielding layer 37 has a thickness of about 75 nm and is doped with a p-type dopant, i.e., Mg or Zn at a concentration of $1\times10^{18}$ to $5\times10^{18}$ $cm^{-3}$.

In the energy diagram of the photocathode 30, like the photocathode 30 shown in FIGS. 5 and 6, the energy level of a conduction band $E_C$ is lowered from the electron shielding layer 37 toward a surface layer 36 through the light absorption layer 34 and the photoelectric emission layer 35 (FIG. 7).

According to this structure, the photocathode 30 can be obtained by almost the same manufacturing method as for the photocathode shown in FIGS. 5 and 6. However, the substrate 32, the electron shielding layer 37, the light absorption layer 34, and the photoelectric emission layer 35 are shaped into rectangular shapes. In addition, a support plate 31 is bonded to the bottom portion of the substrate 32, and a support table 50 is bonded to the side portions of the substrate 32 and the electron shielding layer 37. The photocathode 30 is set at a predetermined position in the vacuum container 20. After this setting, the surface layer 36 is formed on the surface of the photoelectric emission layer 35. The vacuum container 20 is sealed in a high vacuum state, thereby obtaining the phototube 10 having the reflection type photocathode 30.

The function of the third embodiment will be described below.

When a predetermined voltage is applied between the photocathode 30 and the anode 40 from an external power supply (FIG. 10) through lead pins 51 and 52, an electric field is generated from the anode 40 toward the photocathode 30. After this preparation, photons transmitted through the vacuum container 20 are incident on the photocathode 30 through the surface layer 36. When the photons have an energy higher than the bandgap energy of the photoelectric emission layer 35, some photons are absorbed by the photoelectric emission layer 35, although most photons are transmitted through the photoelectric emission layer 35 and absorbed by the light absorption layer 34. To reduce the number of photons absorbed by the photoelectric emission layer 35, the thickness of the photoelectric emission layer 35 is adjusted to about 10 nm.

In the light absorption layer 34, electrons $e^-$ existing in a valence band $E_V$ are excited to the conduction band $E_C$ and become free electrons. Since an energy barrier is present between the light absorption layer 34 and the electron shielding layer 37, the generated photoelectrons $e^-$ are diffused or drifted along the conduction band $E_C$ which is lowered from the light absorption layer 34 toward the surface layer 36 through the photoelectric emission layer 35 without being diffused or drifted into the electron shielding layer 37, and emitted into the vacuum (in the vacuum container 20 outside the photocathode 30) by the negative electron affinity of the surface layer 36. The emitted photoelectrons $e^-$ fly while being accelerated by the electric field generated from the anode 40 toward the photocathode 30, are accepted by the anode 40, and detected by an external ammeter.

Therefore, the phototube 10 exhibits almost the same operation characteristics as those of the above-described phototube (FIGS. 5 and 6).

Fourth Embodiment

In the fourth embodiment (FIGS. 11 and 12), the phototube has a so-called transmission type photocathode having almost the same structure as that of the second embodiment (FIGS. 5 and 6). Particularly, FIG. 12 is a sectional view of the phototube of the fourth embodiment (FIG. 11), which is taken along a line IV—IV in FIG. 11.

Figure 11:
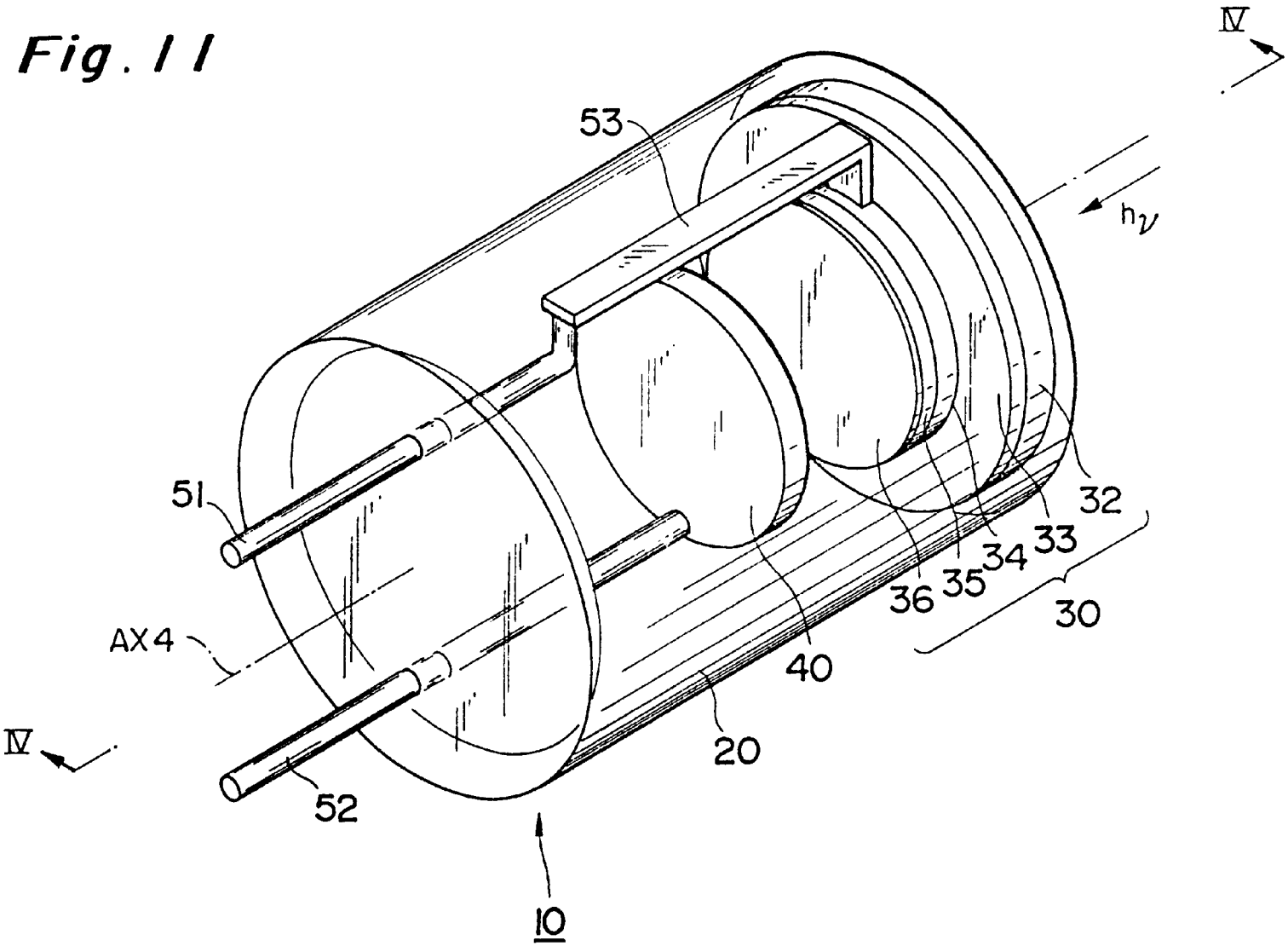
FIG. 11 is a perspective view showing the overall structure of a phototube to which a photocathode according to the fourth embodiment of the present invention is applied (transmission type photocathode)
Figure 12:
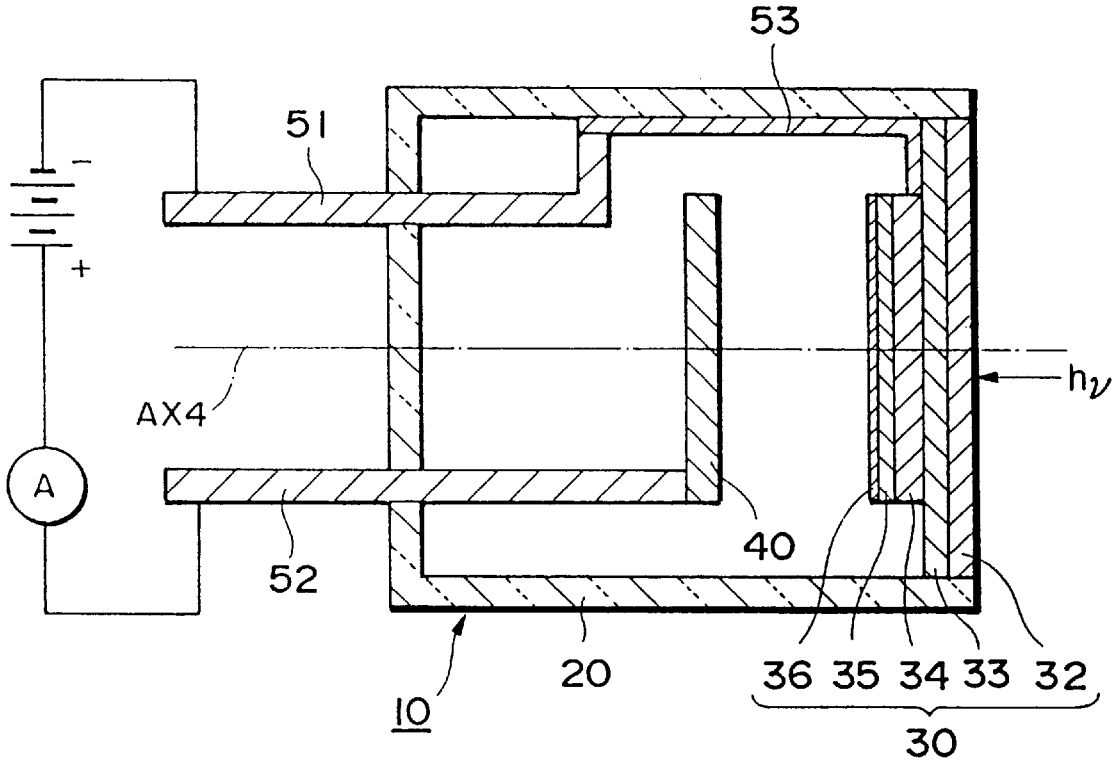
FIG. 12 is a sectional view showing the structure of the phototube taken along a line IV—IV in FIG. 11, to which the photocathode according to the fourth embodiment of the present invention is applied.

As shown in FIGS. 11 and 12, a phototube 10 of the fourth embodiment is different from that of the second embodiment in that a contact layer 33 as in the photocathode 30 shown in FIGS. 1 and 2 is provided between a substrate 32 and a light absorption layer 34 of a semiconductor photocathode 30. More specifically, the contact layer 33 is a p-type compound semiconductor layer mainly containing GaN and epitaxially grown so as to cover the entire surface area of the substrate 32. The contact layer 33 is thinner (thickness: about 10 nm) than that of the photocathode shown in FIGS. 1 and 2 and is doped with a p-type dopant, i.e., Mg or Zn at a concentration of $5\times10^{18}$ $cm^{-3}$.

In the energy diagram of the photocathode 30, like the photocathode 30 shown in FIGS. 1 and 2, the energy level of a conduction band $E_C$ is lowered from the light absorption layer 34 toward a surface layer 36 through a photoelectric emission layer 35 (FIG. 3).

According to this structure, the transmission type photocathode 30 can be obtained by almost the same manufacturing method as for the photocathode shown in FIGS. 1 and 2. However, the substrate 32, the contact 33, the light absorption layer 34, and the photoelectric emission layer 35 are laminated into circular shapes. In addition, the side portion of the substrate 32 is fused to the side wall portion of a vacuum container, and a wiring layer 53 is electrically connected to the surface of the contact layer 33 and the side portion of the light absorption layer 34. Furthermore, the surface layer 36 is formed on the surface of the photoelectric emission layer 35. The vacuum container 20 is sealed in a high vacuum state, thereby obtaining the phototube 10 having the transmission type photocathode 30.

The operation of the fourth embodiment will be described below.

When a predetermined voltage is applied between the photocathode 30 and an anode 40 from an external power supply (FIG. 12) through lead pins 51 and 52, an electric field is generated from the anode 40 toward the photocathode 30. After this preparation, photons transmitted through the substrate 32 (part of the vacuum container 20) of the photocathode 30 are incident in the photocathode 30. When the photons have an energy higher than the bandgap energy of the light absorption layer 34, some photons are absorbed by the contact layer 33, although most photons are transmitted through the contact layer 33 and absorbed by the light absorption layer 34. To reduce the number of photons absorbed by the contact layer 33, the thickness of the contact layer 33 is adjusted to about 10 nm.

In the light absorption layer 34, electrons $e^-$ existing in a valence band $E_V$ are excited to the conduction band $E_C$ and become free electrons. The generated photoelectrons $e^-$ are diffused or drifted along the conduction band $E_C$ which is lowered in level from the light absorption layer 34 toward the surface layer 36 through the photoelectric emission layer 35 and emitted into the vacuum (in the vacuum container 20 outside the photocathode 30) by the negative electron affinity of the surface layer 36. The emitted photoelectrons $e^-$ travel while being accelerated by the electric field generated from the anode 40 toward the photocathode 30, are accepted by the anode 40, and detected by an external ammeter.

Therefore, the phototube 10 exhibits almost the same operation characteristics as those of the above-described phototube shown in FIGS. 1 and 2.

The present invention is not limited to the above embodiments, and various changes and modifications can be made.

In each of the embodiments, as the composition of the p-type $Ga_{1-x}Al_xN$ ($0<x<1$) constituting the light absorption layer of the photocathode, p-type $Ga_{0.6}Al_{0.4}N$ is used. However, when the flow rates of the source gases, i.e., $Ga(CH_3)_3$, $Al(CH_3)_3$, $NH_3$, and $Mg(C_5H_5)_2$ or $Zn(CH_3)_2$ are adjusted in epitaxial growth of the light absorption layer, various compositions of the p-type $Ga_{1-x}Al_xN$ ($0<x<1$) can be set. The spectral sensitivity characteristic of the photocathode is adjusted by changing the absorption edge characteristic in the long wavelength side within the wavelength range of incident light within the wavelength range of about 200 to 350 nm in correspondence with the composition of $Ga_{1-x}Al_xN$, i.e., an alloy of AlN and GaN.

As has been described above in detail, in the photocathode according to the present invention, the photoelectric emission layer mainly containing p-type GaN and the surface layer mainly containing an alkali metal or an alkali metal oxide are sequentially laminated on the light absorption layer mainly containing p-type $Ga_{1-x}Al_xN$ ($0<x<1$). The p-type GaN as the major component of the photoelectric emission layer has a bandgap energy lower than that of the light absorption layer. In addition, the alkali metal or alkali metal oxide as the major component of the surface layer has a vacuum level lower than that of the conduction band of the photoelectric emission layer. For this reason, in the energy diagram of this photocathode, the energy level of the conduction band is lowered from the light absorption layer toward the surface layer through the photoelectric emission layer.

When photons incident in the photocathode has a predetermined energy, the photons are absorbed by the light absorption layer. At this time, electrons existing in the valence band of the light absorption layer are excited to the conduction band and become free electrons. For this reason, the photons are diffused or drifted along the conduction band which is lowered in level from the light absorption layer toward the photoelectric emission layer. The photons which are diffused or drifted from the light absorption layer to the photoelectric emission layer are emitted into the vacuum (outside the photocathode) by the negative electron affinity of the surface layer.

Since the photoelectric emission layer is a p-type compound semiconductor layer mainly containing GaN, Al is not contained in the composition, unlike the light absorption layer. Therefore, the photoelectric emission layer is not easily oxidized, unlike the light absorption layer. The surface of the light absorption layer is covered with the photoelectric emission layer and therefore is not easily oxidized. In addition, the surface layer mainly containing the alkali metal or alkali metal oxide is provided on the surface of the photoelectric emission layer. Since the work function of the surface of the photoelectric emission layer is sufficiently decreased, a negative electron affinity by the surface layer can be obtained.

According to the present invention, since the quantum efficiency is improved, and the absorption edge characteristic on the long wavelength side within the wavelength range of incident light is sharpened, a semiconductor photocathode which achieves a high sensitivity as a so-called solar blind can be provided.

In the phototube to which the reflection type photocathode according to the present invention is applied, the photocathode and the anode are accommodated in the vacuum container to face each other. In the phototube to which the transmission type photocathode according to the present invention is applied, the substrate of the photocathode is arranged as the window portion of the vacuum container, and the anode is accommodated in the vacuum container to face the photocathode. When a predetermined voltage is applied between the photocathode and the anode, an electric field is generated from the anode toward the photocathode. When photons having a predetermined energy are incident in the photocathode, the photons are absorbed by the light absorption layer. Photoelectrons emitted from the surface layer into the vacuum (outside the photocathode) by the above-described function of the photocathode travel while being accelerated by the electric field between the anode and the photocathode, are accepted by the anode, and detected.

According to the present invention, since the quantum efficiency is improved, and the absorption edge characteristic on the long wavelength side within the wavelength range of incident light is sharpened, a semiconductor photocathode which achieves a high sensitivity as a so-called solar blind can be provided.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 6-231317 (231317/1994) filed on Sep. 27, 1994 is hereby incorporated by reference.

What is claimed is:

1. A photocathode for emitting photoelectrons excited by incident light, comprising:

a light absorption layer for absorbing the incident light to excite the photoelectrons, said light absorption layer being a p-type compound semiconductor layer mainly containing $Ga_{1-x}Al_xN$ ($0<x<1$) and having a first major surface and a second major surface opposing said first major surface;

a photoelectric emission layer for drifting the excited photoelectrons, said photoelectric emission layer being a p-type compound semiconductor layer mainly containing GaN and being provided on said first major surface of said light absorption layer; and a surface layer for emitting the excited photoelectrons outside said photocathode, said surface layer comprising at least one of an alkali metal and an alkali metal oxide and being provided at a position opposing said light absorption layer through said photoelectric emission layer.

2. A photocathode according to claim 1, further comprising a substrate provided on said second major surface of said light absorption layer, and wherein said light absorption layer is located between said photoelectric emission layer and said substrate.

3. A photocathode according to claim 2, wherein said substrate includes a plate member mainly containing sapphire.

4. A photocathode according to claim 2, further comprising a contact layer provided between said substrate and said light absorption layer, said contact layer being a p-type compound semiconductor layer mainly containing GaN.

5. A photocathode according to claim 2, further comprising an electron shielding layer provided between said substrate and said light absorption layer, said electron shielding layer mainly containing a semiconductor material having a higher bandgap energy than said light absorption layer.

6. A photocathode according to claim 5, wherein the semiconductor material includes a p-type compound semiconductor material of AlN.

7. A phototube comprising:

said photocathode according to claim 1;

a vacuum container which transmits incident light while accommodating said photocathode and whose interior is held in a vacuum state; and an anode accommodated in said vacuum container and arranged so as to face said surface layer of said photocathode, said anode being set to a higher potential than said surface layer of said photocathode.

8. A phototube according to claim 7, wherein said photocathode further comprises a substrate provided on said second major surface of said light absorption layer, and within said light absorption layer is located between said photoelectric emission layer and said substrate.

9. A phototube according to claim 8, wherein said substrate includes a plate member mainly containing sapphire, said plate member being accommodated in said vacuum container while being separated from an inner wall of said vacuum container by a predetermined distance.

10. A phototube according to claim 8, wherein said substrate includes part of said vacuum container, said part supporting said photocathode.

11. A phototube according to claim 8, wherein said photocathode further comprises a contact layer provided between said substrate and said light absorption layer, said contact layer being a p-type compound semiconductor layer mainly containing GaN.

12. A phototube according to claim 8, wherein said photocathode further comprises an electron shielding layer provided between said substrate and said light absorption layer, said electron shielding layer mainly containing a semiconductor material having a higher bandgap energy than said light absorption layer.

13. A phototube according to claim 12, wherein the semiconductor material includes a p-type compound semiconductor material of AlN.

* * * * *